US005297522A

United States Patent [19]

Buchl

[11] Patent Number: 5,297,522

[45] Date of Patent: Mar. 29, 1994

[54] THROTTLE VALVE

[75] Inventor: Josef Buchl, Lenting, Fed. Rep. of Germany

[73] Assignee: Audi AG, Ingolstadt, Fed. Rep. of Germany

[21] Appl. No.: 927,438

[22] PCT Filed: Mar. 8, 1991

[86] PCT No.: PCT/EP91/00433

§ 371 Date: Sep. 25, 1992

§ 102(e) Date: Sep. 25, 1992

[87] PCT Pub. No.: WO91/15669

PCT Pub. Date: Oct. 17, 1991

[30] Foreign Application Priority Data

Apr. 6, 1990 [DE] Fed. Rep. of Germany ..... 4011182

[51] Int. Cl.[5] ..... F02D 11/10

[52] U.S. Cl. ..... 123/399; 123/400

[58] Field of Search ..... 123/339, 361, 399, 400, 123/396

[56] References Cited

U.S. PATENT DOCUMENTS 4,668,440 5/1987 Sausner ..... 123/339 X
4,747,380 5/1988 Ejiri et al. ..... 123/399
4,951,772 8/1990 Peter et al. ..... 123/361 X
5,014,666 5/1991 Westenberger ..... 123/399
5,018,496 5/1991 Buchl ..... 123/399
5,141,070 8/1992 Hickmann et al. ..... 123/369 X

FOREIGN PATENT DOCUMENTS 3711779 4/1987 Fed. Rep. of Germany .

OTHER PUBLICATIONS

"Patent Abstracts of Japan", vol. 6, No. 220 (M-169), Nov. 1982, abstract of JP,A, 57124037.
"Patent Abstracts of Japan", vol. 7, No. 47 (M-196), Feb. 1983, abstract of JP,A, 57195831.
"Patent Abstracts of Japan" vol. 9, No. 303 (M-434), Nov. 1985, abstract of JP,A, 60142027.

*Primary Examiner*—Tony M. Argenbright
*Attorney, Agent, or Firm*—Lalos & Keegan

[57] ABSTRACT

An operating device for a throttle valve is described, wherein the maximum angle of aperture of the throttle valve is determined mechanically, while smaller angles can also be actuated electrically. An idling admission control can be integrated into an electric actuation, and a stop ensures a mechanically determinable minimum angle of aperture >0°. A constant force distance line in the actuation of the accelerator is additionally ensured.

4 Claims, 1 Drawing Sheet

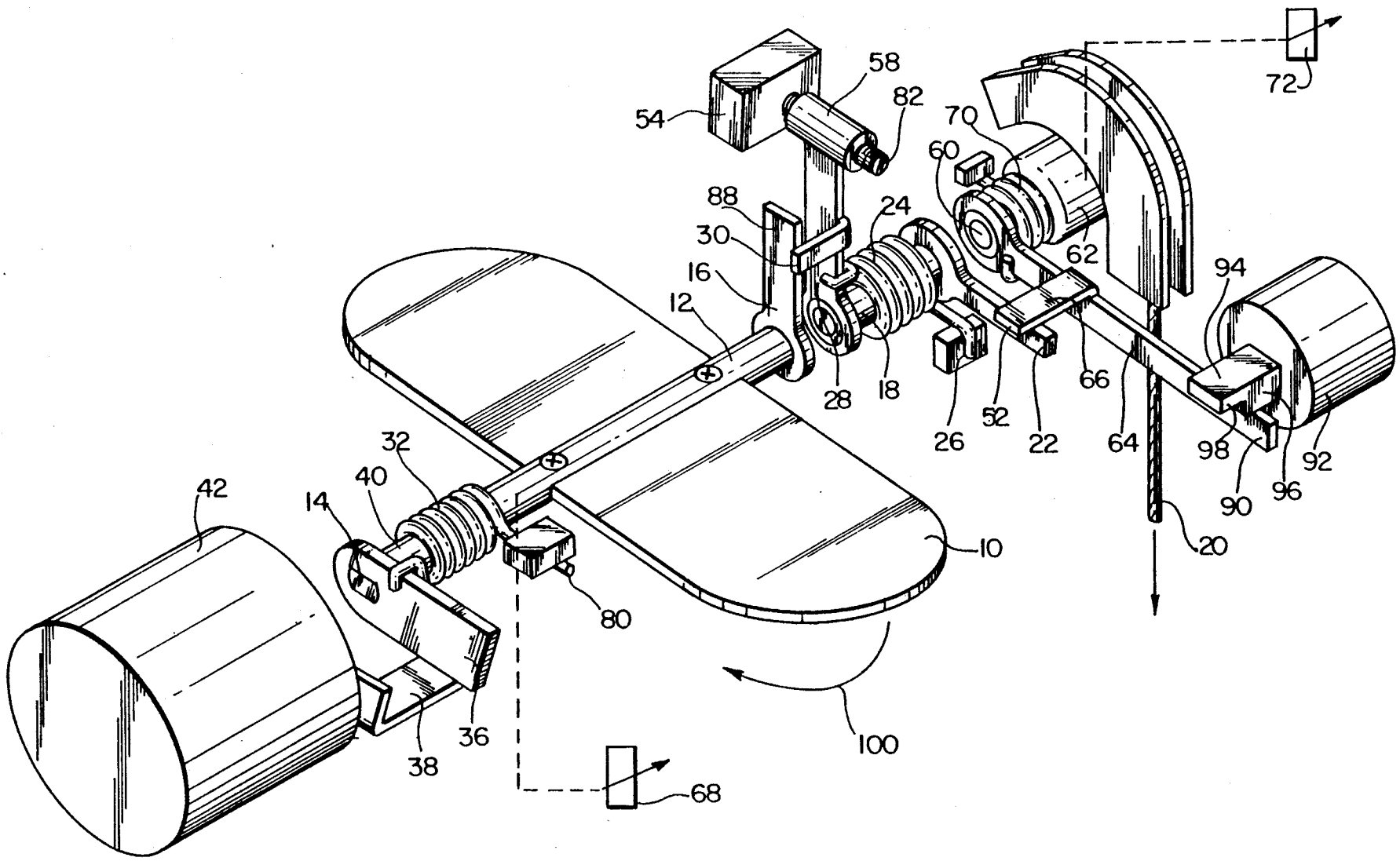
72
92
96
94
90
98
20
64
62
66
22
52
70
60
26
10
82
58
24
18
100
28
88
30
16
12
54
68
80
36
38
32
40
14
42

THROTTLE VALVE

The invention relates to a throttle valve for an internal combustion engine.

Such a throttle valve is described in DE-A 37 11 779. This known throttle valve is moved via a servomotor between the completely closed position (zero degree position) and the maximum open position, which is determined by a mechanical transmitter. When the accelerator is not actuated, the mechanical transmitter brings about complete closure of the throttle valve, and thus the safety of a mechanical accelerator is achieved whilst preserving the possibilities of control of an electronic accelerator.

In the document EP-A 341 341 there is disclosed a throttle valve (16) mounted on a shaft, said throttle valve comprising an accelerator, which actuates a mechanical cable pull, said cable pull acting on a pivoting part. The pivoting part is cooperating with a stop point to displace the same, and furthermore there is provided a spring for biasing the throttle valve in the direction of the stop point. A servo motor is controlling the degree of opening of the throttle valve between the closed position and the maximum open position defined by the stop point. A restoring device actuates the stop point in the direction of the closed position on a throttle valve when the mechanical cable pull is slick, wherein stop limits the pivoting of the pivoting part to a minimum angle which is larger than the idling position of the throttle valve. A reference volume trasmitter is provided for the throttle valve position and an actual volume transmitter is associated with the servo motor.

The object of the invention is so to improve a throttle valve of the generic type that idling admission control is possible via the servomotor and the emergency properties are retained intact.

The European Patent Application 89105378, published on Mar. 10, 1990 as Document Number 0 389 649, describes a throttle valve actuator for solving the problem, wherein the throttle valve is not closed by the cable pull, but the fuel inlet only closes up to an angle of approximately 10°, and the remaining angular range between 0° and 10° is adjusted by the electric motor.

The haptic accelerator pedal feeling is impaired by a change in the power line of the actuation. This is changed by the measures proposed in the invention.

The invention proposes that the stop actuator is associated directly with the component actuated by the fuel inlet in order to limit the mechanical closure of the throttle valve.

The invention is illustrated in detail below with the aid of the FIGURE.

In the FIGURE, a throttle valve referenced 10 is installed in an induction tube of an internal combustion engine, which would have to run vertically in the diagram shown here. The throttle valve 10 is shown in the closed state, is pivotable about a shaft 12, and a swivel in the direction of the arrow 100 would move the throttle valve 10 into its open position.

The shaft 12 is bent at an angle at one end to form a radial continuation 16 which is forcibly joined to the throttle valve 10 in terms of movement, and in the continuation of its axis 14, the shaft of an operating element 18 is coaxially mounted, which has a drive lever 22 and a driven lever 28. Pivoting of the operating element 18 is controlled via the drive lever 22, and the driven lever 28 transmits this pivoting, in a manner yet to be described, to the radial continuation 16, which is forcibly joined to the throttle valve 10 in terms of movement. Furthermore, a restoring spring 24 acts on the drive lever 22, or, as shown here, on the driven lever 28, the other end of said spring being coupled to the point 26 on the housing. This restoring spring 24, which for safety reasons is formed as a double spring, acts on the throttle valve 10 in its closed position.

The driven lever 28 has a dog 30 running parallel to the axis 14 and being in contact with the continuation 16. A stop spring 32, when stressed, moves the throttle valve 10 into its open position and thus moves the continuation 16 into its contact position with the dog 30 of the operating element 18. In this case, it is essential that the spring 32 has a smaller spring force characteristic line than the restoring spring 24, i.e. is weaker. The spring 32 can connect the continuation 16 directly to the driven lever, but may also, as is shown in the drawing, exert a torque on the shaft 12 by one end, and by the other end 80 can be permanently coupled to the motor.

An extension 50 of the driven lever 28 of the operating element 18 has on its end 58 an adjustable stop screw 82, which comes into contact with a stop limiter 54 and thus limits pivoting of the operating element 18 in the closed position of the throttle valve 10.

The operating lever 18 is rotated in the direction of the open position of the throttle valve 10, i.e. in the direction of rotation of the arrow 100, by a pivoting part 60, which can be pivoted by actuation of a cable pull 20, which is connected to an accelerator (not shown).

In the FIGURE, the shaft 12 of the throttle valve 10, the axis of rotation of the operating element 18 and the axis of rotation of the pivoting part 60 are oriented coaxially to one another.

A counter-arm formed as an operating lever 64 can be pivoted about this axis 14 by means of a cable lever 62, on which the cable pull 20 acts. The operating lever 64 has a dog 66, which presses against one side of the drive lever 22 of the operating element 18 and thus moves this operating element 18 in the direction of the open position.

A restoring spring 70 is provided, which ensures that, when the accelerator is not actuated and the cable pull 20 is therefore slack, the pivoting part 60 is moved into its zero position.

A reference value transmitter 72 is associated with the pivoting part 60 and transmits a signal as a sensor by electrical means, which signal represents the load requirement, as is generated by actuation of the accelerator by the driver.

A further means of affecting the position of the throttle valve 10 is possible via the servomotor 42. The servomotor 42 is actuated by electronics. In this case, a slip regulator may be used, for example. The actuating electronics furthermore takes into account consumption-optimised characteristic lines, according to which the electric motor 42 can be actuated to open or close the throttle valve 10. Measures for damping the change of load impact when the throttle valve 10 opens suddenly can also be taken into account here.

In order to counteract sudden slipping, a change of load impact or even excessively high consumption, the throttle valve 10 is intended to be actuated in the direction of its closed position. To this end, the electric motor 42 is actuated. Thus a dog 38 presses against a radial tappet 36 and turns the shaft 12 in the direction opposite to that of the arrow 100. Thereby, in the stop point 88, the continuation 16 disengages from the dog 30 of the operating element 18, stresses the spring 32 in the opposite direction from its actuating direction, and the throttle valve is closed by the amount specified by the electronics.

An actual value transmitter 68, which determines the actual degree of closure of the throttle valve 10, is associated either with the shaft 12 or the shaft 40 and supplies a value for the actual throttle valve degree of aperture.

The operating lever 64 has on its end remote from the axis an extension 90, which comes to rest on a stop 94 when the accelerator is not actuated, and this position corresponds to an open position of the throttle valve of approximately 10°. The stop 94 can be formed by a pin, which can be extended or retracted by an electromagnet 92, and which is extended when the electromagnet 92 is not excited. The pin has two steps 96 and 98, the step 96 being the one which forms the stop point for the extension 90 in an emergency.

When the electromagnet 92 is excited, the pin 94 is retracted, and the extension 90 does not come into contact with the pin 94, which corresponds to a smaller degree of aperture of the throttle valve. This is the emergency step, and the exact minimum degree of aperture of the throttle valve is in this case formed with the adjustable stop screw 82.

In a further stage of excitation with a lower voltage actuation, the pin is half retracted and the extension 90 comes into contact with the step 98.

The function of the device shown is the following:

Due to pulling on the accelerator 20, the pivoting part 60 is rotated about its axis and presses via the dog 66 in the stop 52 on the drive lever 22 of the operating element 18. Thereby, the operating element 18 is pivoted clockwise in the drawing, permitting pivoting beyond the degree predetermined by pivoting of the pivoting part 60, i.e. during actuation of a speed control device, and in this case the drive lever 22 would no longer come into contact with the dog 66 of the pivoting part 60 at the point 52.

The restoring spring 24, however, holds the drive lever 22 in contact with the point 52, unless any further resistances, e.g. an actuated speed control device, prevent it.

The pivotal motion of the operating element 18 is transmitted via the dog 30 of the operating element 18 to the continuation 16, which is connected to the shaft 12 of the throttle valve 10, since the spring 32 presses the continuation 16 into contact with the dog 30, unless any further forces affect the throttle valve 10. In this manner, the maximum angle of aperture of the throttle valve 10 is ensured, whereas the throttle valve 10 can freely close in the direction opposite to that of the arrow 100, provided that the closure force exceeds the spring constant of the spring 32.

Closure of the throttle valve between the maximum degree of aperture, which is determined by the position of the accelerator cable pull 20, and the completely closed position, is set by the servomotor 42.

The parameters for actuating the motor 42 are determined by suitably prescribed parameters stored in memories and by vehicle operating parameters (speed, revolution count, accelerator characteristic lines and the like), and the values supplied by the transmitters 68 and 72, and in particular 68 for the actual position of the throttle valve 10 and 72 for the reference position of the throttle valve 10, as is prescribed via the load requirement determined by the accelerator.

Complete mechanical closure of the throttle valve is prevented in normal operation, in particular by the extended pin 94, so that the step 96 comes into contact with the extension 90, which mechanically limits the degree of aperture of the throttle valve to approximately 10°. The reference value potentiometer 72 in this state gives the control the information that the accelerator is not actuated, whereby the appropriate idling setting occurs, which is controlled via the electric motor 42. In this range between 0° and 10°, the exact position of the throttle valve 10 is therefore brought about via actuation of the electric motor 42.

The lower value set via the stop actuator 58 for the angle of aperture with a retracted pin 96 is so selected that the necessary play is available for emergency operation. In the case of a defect, the vehicle can therefore still be operated.

An important area for the application of the invention is damping of the so-called change of load impact. When the accelerator is suddenly pressed down, although the pivoting part 60 and the operating element 18 are abruptly rotated, and therefore the maximum angle of aperture is moved upwards, the servomotor 42 controls the actual aperture of the throttle valve 10, in order thus to achieve a softer response, which increases the acceleration comfort without noticeable losses in performance.

On the other hand, in the case of a sudden release of the accelerator, the throttle valve 10 is not completely closed, but due to the stop actuator 54, a minimum aperture of 11° (as an example of a value) is guaranteed, so that even in this case, there is no abrupt change of load impact due to complete removal of the load.

To test the electromagnet 92, it can be arranged that, during travel, if the potentiometer 72 indicates pivoting, the pin 96 is half retracted, and the electromagnet 92 is not excited and the pin extended until the accelerator is released, and until therefore the operating lever 66 closes. Therefore, interplay of the step 96 and the extension 90 is possible in normal operation. If a fault is detected, the pin 94 is not extended, so that the above-mentioned emergency position pertains, in which the setting of the throttle valve 10 is mechanically controlled.

I claim:

1. Throttle valve (10) for an internal combustion engine, having a) a shaft (12), on which the valve (10) is mounted, b) a stop point (30), which limits the opening movement of the throttle valve (10) in the direction of the open position, c) a device (18, 20) for displacing the stop point (30) in the direction of the open position in response to the actuation of a mechanical cable pull (20) via the accelerator, d) a spring (32) biasing the throttle valve (10) in the direction of the stop point (30), e) a servomotor (42) which controls the throttle valve (10) between its closed position and its maximum open position defined by the stop point (30), f) a restoring spring (24), which actuates the stop point in the direction of the closed position of the throttle valve (10) when the mechanical cable pull (20) is slack, and g) said throttle valve biasing spring (32) being weaker than said restoring spring (24), h) a reference value transmitter ( 72) for a pivoting part (60) and an actual value transmitter (68), associated with the servomotor (42), for the throttle valve position, i) the mechanical cable pull (20) acting on the pivoting part (60), which cooperates with the stop point (88) in order to displace the same, j) a pivoting restoring spring (70) biasing the pivoting part (60) in the closing direction, k) a stop actuator (92) associated with the pivoting part (60) and, in normal operation, limiting the pivoting of the pivoting part in the closing direction to a minimum angle which is larger than the idling position of the throttle valve (10), characterized in that l) said stop actuator (92) consists of an electromagnet, which in the excited state moves out a pin (94), in order actively to engage a first step (96), m) the stop actuator (92) defines two steps, the first corresponding to normal operation, and the second being actuated if a malfunction of the servomotor (42) is detected, n) said second step permitting further closing of the throttle valve in comparison to the first step, o) a stop limiter (54) limits the pivoting of the stop point (30) in the throttle valve close direction.

2. Throttle valve according to claim 1, characterised in that a setting device (58) is associated with the device (18, 60) for displacing the stop point (30), which sets exact minimum degree of opening of the throttle valve (10) in the throttle valve close direction, when the second step is actuated.

3. Throttle valve according to claim 2, characterised in that the setting device (58) defines the minimum open position of the device (18) for displacing the stop point, which displaces the stop point between the maximum position defined by the pivoting part and the minimum position defined by the stop actuator.

4. Throttle valve according to claim 1, characterised in that the electromagnet (92) actuates the second step (98) in the non-excited state by moving out the pin (94).

* * * * *